United States Patent [19]

Boyer

[11] 4,080,179

[45] * Mar. 21, 1978

[54] COLLOIDAL MAGNESIUM SUSPENSION IN CRITICAL LOW CONCENTRATION IN MOTOR GASOLINE AND METHOD OF PREPARATION

[76] Inventor: Winston Boyer, The Boyer Ranch, Savery, Wyo. 82332

[ * ] Notice: The portion of the term of this patent subsequent to Mar. 21, 1995, has been disclaimed.

[21] Appl. No.: 569,320

[22] Filed: Apr. 17, 1975

[51] Int. Cl.[2] ..... C10L 1/32

[52] U.S. Cl. ..... 44/51; 44/67; 252/309

[58] Field of Search ..... 44/51; 252/309; 149/87

[56] References Cited

U.S. PATENT DOCUMENTS

| | | | |
|---|---|---|---|
| 2,671,758 | 3/1954 | Vinograd et al. | 252/309 |
| 3,069,854 | 12/1962 | Toulmin, Jr. | 149/87 |

*Primary Examiner*—Daniel E. Wyman
*Assistant Examiner*—Mrs. Y. Harris-Smith

[57] ABSTRACT

A colloidal magnesium suspension is prepared by grinding 400 mesh pure magnesium (99.8+%) in dry kerosene until it reaches colloidal dimensions (from about 500 to 1 millimicron) and is thereafter added in critical low concentration of 1/5 gram as substantially pure magnesium up to about 10 grams per 10 gallons of motor gasoline whereby improved burning of the gasoline is observed as evidenced by improvement in gas mileage of about 25% for the same spark and carburetor settings as compared with the gasoline to which the colloidal magnesium has not been added. Benefits are achieved with leaded as well as unleaded gasoline. Optimum amounts of about 1 - 2 grams of colloidal magnesium in 10 gallons are preferred in order to minimize air pollution, while giving maximum benefit for fuel economy.

3 Claims, No Drawings

COLLOIDAL MAGNESIUM SUSPENSION IN CRITICAL LOW CONCENTRATION IN MOTOR GASOLINE AND METHOD OF PREPARATION

CROSS REFERENCE TO RELATED APPLICATIONS

Application of Winston Boyer entitled, "Colloidal Magnesium Suspension in Critical Low Concentration in Diesel Fuel," filed on even date herewith Ser. No. 568,999, filed Apr. 17, 1975.

Application of Winston Boyer entitled, "Colloidal Magnesium Suspension in Critical Low Concentration in Aviation Turbine Fuel," filed on even date herewith, Ser. No. 568,998, filed Apr. 17, 1975.

BACKGROUND OF THE INVENTION

A. Field of the Invention

The invention lies in the field of suspension of non-gaseous solid materials, these materials being in colloidal size and obtained by grinding very finely divided substantially pure magnesium metal in dry substantially easily burning low volatility petroleum, and in particular kerosene and also is in the field of suspensions of this colloidal dispersion of substantially pure magnesium (500 to 1 millimicrons) in motor gasoline in critical proportions for the purpose of aiding combustion in the motor gasoline, there being no non-oxyhydrocarbons or non-hydrocarbon additives required for the addition and suspension and thereby controlling emissions, while improving fuel economy and efficiency of lead-free and leaded gasoline.

B. Description of the Prior Art

1. Motor Fuel Economy and Emission Controls

The problem of fuel economy and emission controls has come to the forefront since the Arab Oil Embargo in 1973–74 and has gripped the attention of the auto manufacturer, the supplier of the add-on catalytic converter and the domestic oil industry in the United States. Smaller cars with new engines such as the Japanese Honda Civic CVCC (compound vortex combustion chamber) have shown under E.P.A. tests 39 miles per gallon in simulated urban driving (see article by Fred Gregory in the New York Times, February 2, 1975, page A17 of Business Section) and have passed the emission standards.

However, the bulk of the cars on the road in the United States are older and heavier cars with less revolutionary engines and interim efforts are being directed to add-on pollution control devices, such as the platinum catalyst charged converter which cuts emissions to meet standards in the states and of the Federal Government. The results these past 10 years have been encouraging as stated by Gladwin Hill in the New York Times, Business Section, page A15, who reports as follows:

In 1966, when cars began using exhaust controls, the Los Angeles County Air Pollution Control District reported that the area's 3,770,000 cars were spewing out 10,485 tons of carbon monoxide each day, 1,805 tons of hydrocarbons (unburned gasoline) and 545 tons of oxides of nitrogen.

Today, with 4,470,000 cars in the area, the total is down to 5,040 tons of carbon monoxide, a 50 percent decrease; 625 tons of hydrocarbons, a two-thirds decline, and 530 tons of oxides of nitrogen. Nitrogen oxide controls are relatively new and difficult to remove.

In 1966, there were 271 days of excessive oxidants (compounds formed from car fumes by sunlight, and often irritating to the eye); 89 days of excessive nitrogen oxides, which accounts for the brownish tint to smog, and 365 days of excessive carbon monoxide.

In 1973, there were 185 days of excessive oxidants, 59 days of excessive nitrogen oxide, and 116 days of excessive carbon monoxide.

For the first 10 months of 1974, the totals were 202 days of excessive oxidants, 44 days of excessive nitrogen oxides and 71 days of excessive carbon monoxide.

The main block to further reduction in emissions is the use of tetraethyllead (TEL) in gasoline, which poisons the catalyst in the add-on converter and for this reason, lead-free gas is now required for the new model cars.

The literature is replete with gasoline additives, but it is pointed out by Kirk-Othmer at Volume 12, page 293: "In worldwide use, the tetraalkyllead compounds reign supreme as gasoline additives. Essentially all the compounds produced are converted into anti-knock fluids used to suppress knock in the internal-combustion engine. Knock tends to limit power output, and to preclude the use of higher-compression engines. Since higher compression ratios are more efficient thermodynamically, they allow greater economy or greater power output, as desired." As engines continue to improve in the future, it is to be expected that the use of anti-knock agents will be required to keep pace with their development.

"The technology of the control of knock is well developed. Many anti-knock agents are known, but except for methylcyclopentadienylmanganese tricarbonyl (used in Ethyl's Motor 33 Mix), practically none is used commercially outside the tetraalkyllead group. In the United States, however, probably over 80% of lead alkyl production is in the tetraethyl form. In various periods, especially under wartime conditions, other materials, such as monomethylaniline and iron pentacarbonyl, have been used to increase anti-knock quality. However, the aniline derivative is costly in the high concentrations required, while iron carbonyl suffers from its serious effect on engine durability.

"At present, the lead alkyl anti-knocks are an important tool for petroleum companies (along with improved refining processes) in increasing the octane rating of gasolines. Such anti-knocks are used in over 97% of all motor fuel consumed, at levels up to 4 ml per U.S. gallon."

2. Prior Patent Art a. Methods of preparing Colloidal Metal Suspensions

Various methods are known for making colloidal metals, for example, Vaughn, U.S. Pat. No. 2,123,617, describes a method of making colloidal metal by reaction in liquid ammonia, and the literature makes references to electrolytic processes for the manufacture of colloidal magnesium.

These prior methods are expensive to carry out, because of the high cost for equipment and the need for highly skilled personnel, not to mention the high energy requirement for electrolytic processing. A further important disadvantage is the formation of impurities, oxides or nitrides, which occurs because of the high reactivity of magnesium.

In contrast to the above methods for preparing colloidal magnesium, the present process carries out the grinding by starting from 400 mesh pure (99.8+%)

magnesium powder, which is dispersed in dry kerosene. The dispersing liquid is substantially free from water, and thus eliminates one of the most important reactions of metallic magnesium, which is that with water. Under ordinary atmospheric conditions or in pure water or saltfree water of high pH, however, the reaction is self-stopping, because of the formation of an insoluble hydroxide film:

$$Mg + 2\,H_2O \rightarrow Mg(OH)_2 + H_2$$

b. Finely Divided Magnesium in Fuels

The patent to Toulmin, Jr., U.S. Pat. No. 3,122,429, discloses slurry of magnesium, finely divided coal and ozone in jet fuel in weight ratio of 25/75 solid fuel to liquid fuel.

The patent to Toulmin, Jr., U.S. Pat. No. 3,147,091, discloses a composite fuel of 35% by weight of powdered coal and magnesium and remainder liquid hydrocarbon.

The patent to Nixon et al, U.S. Pat. No. 3,709,747, discloses 50 to 70% by weight of finely divided metal in JP-4 Jet fuel with emulsifier and formamide.

The patent to Nixon et al, U.S. Pat. No. 3,732,084, discloses 60% by weight of finely divided coal and emulsifier in JP-4 Jet fuel and formamide.

OBJECTS OF THE INVENTION

In contrast to the teaching of the Toulmin, Jr. in U.S. Pat. Nos. 3,122,429 and 3,147,091, at column 1, first paragraph of these patents, the present invention employs colloidal magnesium in critically low proportions lying below any increase in calorific value of the fuel, and a basic objective of the invention is to provide pure, oxide-free magnesium in colloidal suspension in dry kerosene, for the purpose of increasing fuel economy of motor gasoline in internal combustion engines.

In further contrast to the teaching of the foregoing Toulmin, Jr. patents at column 2 of each relating to metal soap additives such as magnesium or aluminum stearate or the like to coat the metal particles, the present invention uses pure colloidal magnesium free from any soaps, which would detract from chemical activity of the free metal surface of the colloidal particles of magnesium, thereby assuring that the oxidation of colloidal magnesium occurs in the compression chamber of the engine to thereby promote complete burning of the motor gasoline, and it is an objective of the invention to use pure colloidal magnesium metal having free and uncoated metal surfaces, which do not come into any contact with polluting surface active metal salts, or other metals or oxidizing agents.

In contrast to the emulsions of the Nixon et al patents, above mentioned, which require the use of toxic solvents, such as formamide or dimethyl formamide, the present colloidal magnesium suspension, consists essentially of combustible hydrocarbons, dry kerosene, and gasoline as the dispersant and active free metal particles between 500 and 1 millimicron, is free from nitrogen compounds or sulfur compounds acting as pollutants, and it is a further object of the invention to provide a non-toxic combustion promotor composition for motor gasoline, which does not add to pollution by adding oxides of sulfur or nitrogen.

In further contrast to the substantial water content of the above mentioned Nixon et al emulsions for JP-4 Jet fuel in the prior art, the present colloidal magnesium suspension in hydrocarbon dispersant is water-free and dry, and it is a further object of the invention to provide a dry combustion system for motor gasoline in which the active colloidal magnesium ingredient is in a dry state and the hydrocarbon liquid dispersant, motor gasoline, is likewise in a dry state to thereby prevent oxide formation due to water.

The foregoing and other objects of the invention will be more readily understood in view of the summary of the invention and the following description of the preferred embodiments of the invention in the Examples.

SUMMARY OF THE INVENTION

Colloidal magnesium metal of high purity (99.8+%) prepared by grinding 400 mesh pure magnesium in dry kerosene is added in critical low concentrations of 1/5 to 10 grams, preferably about 1 – 2 grams in each 10 gallons of leaded or unleaded gasoline and provides improved burning as evidenced by increased gas mileage of about 25% as compared with the same gasoline to which the colloidal magnesium has not been added.

DESCRIPTION OF THE PREFERRED EMBODIMENTS

Example 1

Preparation of Colloidal Pure Magnesium in Dry Kerosene by Grinding

Commercially pure 400 mesh magnesium metal (99.8+% and about 0.003% each of aluminum and copper, 0.03% iron, 0.08% Manganese, 0.001% nickel, and 0.005% silicon) supplied by Reed Manufacturing Company, Lakehurst, New Jersey, is dispersed in dry kerosene in a ratio of 25 parts by weight of magnesium (50 grams) to 75 parts by weight of dry kerosene, and the entire mixture is charged into the 17¾ inch diameter mixing bowl of a Vulcan Hart Heavy Dough Mixing Machine, which grind in the mixing bowl by rotary rubbing movement of a top moving circular steel plate of ½ inch thickness and 11¾ inch diameter against a base circular plate of ¼ inch thickness by 17¼ inch diameter. To eliminate contamination by iron particles, the base plate was replaced by a 3% Al – 1% Zn – magnesium plate ¼ inch thick and 17 inches in diameter. The rubbing movements of the top plate are controlled by eccentrics to define an ovoid movement in different portions of the larger base plate.

After 8 hours of grinding, the suspension was filtered and determined to be colloidal (microscope examination) between 1 and 500 millimicrons. The mixture was filtered through fine cloth and less than 1% was removed.

Grinding in 20 weight motor lubrication oil, Pennsylvania grade, was unsuccessful and the particles did not break down. Grinding was attempted in unleaded gasoline, but after a short time, ½ hour, the grinding was abandoned, because of the highly inflammable fumes which developed.

EXAMPLE 2

Mixing Colloidal Magnesium in Motor Gasoline and Testing in 1966 Ford with Leaded Gasoline The carburetor and spark in the 1966 Ford (240 cu. in. displacement) were adjusted for leaded gasoline, containing about 2.3 grams of lead per gallon, the research octane number of the gasoline being between 93 and 94, and a base mileage figure was observed in a series of driving tests of 100 miles each.

The same leaded gasoline, regular grade, was used as in the basic tests, but there was added for each 10 gallons of gasoline 2.5 grams of magnesium, e.g., 1/20 of the total charge in the grinding machine and for this dosage eleven separate driving tests were carried out.

No overheating was observed during the test drives. The exhaust manifold, muffler, and exhaust pipe were carefully inspected after each test. A very thin deposit of white magnesium oxide covering an area of about ½ inch was noted at an aperture in the exhaust pipe to the muffler after the 11th test.

The average increase in gas mileage for the eleven tests was 25%.

EXAMPLE 3

Testing with Unleaded Gasoline

The same pretesting condition was established as in Example 2 above for a base trial run of the same 1966 Ford but using unleaded gasoline of octane number of 87, this gasoline being adapted for the 1975 cars fitted with add-on platinum catalytic converter. After the spark and carburetor setting had been adjusted for proper performance with this unleaded gasoline, a series of trial runs were made to establish the control mileage figure. Then as in Example 2 above, 2.5 grams of colloidal magnesium were added to 10 gallons for each trial run. Comparable results were achieved, e.g., an increase in fuel economy of about 25%.

In the foregoing examples, just a few of the extensive mileage tests are set out as illustrative of a higher level of colloidal magnesium dosage; still other tests carried out at lower concentrations of 0.15 grams of magnesium in 10 gallons show equally beneficial results. The minimum may be perferred under urban driving conditions where pollution is a serious factor.

By increasing the level of colloidal magnesium of from 5 to 10 grams per 10 gallons, one may encounter suspension problems and further be adding relatively expensive material at levels where it is not contributing any benefit beyond the optimum level of 1 to 3 grams of magnesium per 10 gallons. Dispersion is added by adding simple oily agents, such as STP or oxidized petroleum oils.

I have found that motor gasolines are uniformly benefited at the present critical leads — (1/5 to 10 grams Mg per 10 gallons) in the produce classifications of aviation gasoline, motor gasoline, while the level is entirely different in Diesel fuel and in jet fuel as explained in my copending applications.

These aviation gasolines and motor fuels and their compositions are as follows:

Table 1

| Product | Refinery stream used |
|---|---|
| Aviation gasolines | |
| grade 80–87 | blend of catalytically cracked and straight-run naphthas with some alkylate and isopentane |
| grade 91–98 | same as grade 80–87 |
| grade 100–130 | blend of catalytically cracked naphthas and alkylate with some isopentane |
| grade 108–135 | same as grade 100–130 |
| grade 115–145 | alkylate and some isopentane |
| Motor gasolines | |
| regular grade | blend of thermally or catalytically cracked, reformed, polymerized and straight-run naphthas |
| premium grade | blend of catalytically cracked, reformed, polymerized and straight-run naphthas; alkylate |

I am familiar with prior proposals to inject colloidal lead into the combustion chamber by using an organic compound of lead, such as in Alleman, U.S. Pat. No. 1,805,199, (lead from tetraalkyllead).

Also, I am aware of Gorsich, U.S. Pat. No. 3,431,212, who teaches a vinyl grignard reagent for reaction with lead chloride to make vinyl lead compounds. These compounds are much more expensive and hazardous to make and to use than the simple colloidal preparation of the present invention, and the advantages of the present invention over the compounds of these patents is readily seen.

As explained in my copending applications "Colloidal Magnesium Suspension in Critical Low Concentration in Diesel Fuel" and "Colloidal Magnesium Suspension in Critical Low Concentration in Aviation Turbine Fuel", the critical concentration of magnesium in diesel fuel and in aviation turbine fuel is significantly different from the concentration in motor gasoline and due to the fact that the concentrations in motor gasoline does not effect the carburetor setting or the spark adjustment setting, which indicates that there is no change in octane number of the motor gasoline, it appears that the main function of the colloidal magnesium in motor gasoline is as a catalytic agent effecting the completeness of combustion of the hydrocarbons in the fuel under the conditions of compression and temperatures in the firing chamber. In the Table II, Table III and Table IV, below, are given the specifications of motor gasoline, diesel fuel and, gas turbine fuels, respectively, these taken from pages 86 and 87 of Kirk-Othmer, Encyclopedia of Chemical Technology, Volume 15:

Table 2

Specifications of Motor Gasoline (ASTM D 439) (6)

| Properties | Types A | Types B | Types C |
|---|---|---|---|
| octane number, research, av | | | |
| regular grade | | 94 | |
| premium grade | | 100 | |
| octane number, motor, av | | | |
| regular grade | | 86 | |
| premium grade | | 92 | |
| distillation, ° F | | | |
| 10% evaporated max, winter to summer | 140–158 | 140–158 | 167 |
| 50% evaporated, max | 284 | 257 | 284 |
| 90% evaporated, max | 392 | 356 | 392 |
| vapor pressure, max, winter to summer | | 15.0–10.0 | |
| gum, existent, max, ml mg/100 ml | | 5 | |

Table 3

Specifications of Diesel Fuel Oils (ASTM D 975) (6)

| Properties | Grades No. 1-D | Grades No. 2-D | Grades No. 4-D |
|---|---|---|---|
| distillation, 90% pt, ° F | 550 max | 540–640 | |
| flash pt, min, ° F | 100 | 125 | 130 |
| pour pt, max, ° F | 10° F below ambient Temp. | | |
| water and sediment, max, vol % | trace | 0.10 | 0.50 |
| carbon in 10% residuum, max, % | 0.15 | 0.35 | |
| ash, max, wt % | 0.01 | 0.02 | 0.10 |
| viscosity, kinematic, cS at 100° F | 1.4–2.5 | 2.0–4.3 | 5.8–26.4 |
| sulfur, max, wt % | 0.50 | 1.0 | 2.0 |

Table 3-continued

| Specifications of Diesel Fuel Oils (ASTM D 975) (6) | | | |
|---|---|---|---|
| | Grades | | |
| Properties | No. 1-D | No. 2-D | No. 4-D |
| octane number, min | 40 | 40 | 30 |

Table 4

| Specifications of Aviation Turbine Fuels (ASTM D 1655) (6) | | | |
|---|---|---|---|
| | Type | | |
| Properties | Jet-A | Jet A-1 | Jet B |
| gravity, ° API | 51–39 | 51–39 | 57–45 |
| distillation, ° F | | | |
| 10% evaporated, max | 400 | 400 | |
| 20% evaporated, max | | | 290 |
| 50% evaporated, max | 450 | 450 | 370 |
| 90% evaporated, max | | | 470 |
| final boiling pt, max | 550 | 550 | |
| vapor pressure, max, psi | | | 3 |
| flash pt, ° F | 110–150 | 110–150 | |
| freezing pt, max, ° F | −36 | −54 | −56 |
| viscosity, kinematic, max, cS at −30° F | 15 | 15 | |
| net heat of combustion, min, Btu/lb | | 18,400 | |
| sulfur, max, wt % | | 0.3 | |
| water tolerance, max, ml | | 1 | |
| gum, existent, max, mg/100 ml | | 7 | |
| aromatics, max, vol % | | 20 | |

It is noted that the minimum and optimum concentrations in diesel fuel are lower than in motor gasoline, while the minimum and optimum concentrations in aviation turbine fuel are substantially higher than in motor gasoline.

The average diesel engine is more precisely adjusted and less likely to change in its adjustment during constant use. The use of the diesel truck for long hauls is characterized by a constant speed, a lower maximum speed and by slower acceleration. The two types of driving performance automobile and truck lead to better gas mileage for country driving. The type of performance of quick starting and quick stopping in city driving, which is characteristic of driving in the ordinary passenger automobile, leads to poor gas mileage.

In accordance with the above theory, it is believed that the different amounts required for these three different kinds of fuels are based upon complex factors including compression, volatility of the fuel, combustion temperature, and completeness of combustion, which depends upon pressure composition and temperature, air fuel ratios, chemical compositions of refinery stream used (fraction of cycle is), and the condition of adjustment of the vehicle including the spark setting and carburetor setting.

As mentioned herein above in the Field of the Invention, the most practical dispersing agent for addition to the gas tank is kerosene from the point of view of economy and availability, but is is frequently desirable to add oxygenated hydrocarbons to aid the suspension of the colloidal dispersion of pure magnesium. A commercially available class of such dispersing agent is known as "Alox" Compounds, which is a trademark for mixtures of organic acids, oxyacids, and esters derived from oxidation of petroleum hydrocarbons and is supplied by Alox Corporation, P. O. Box 556, Niagara Falls, N. Y.

As pointed out in Kirk-Othmer, Encyclopedia of Chemical Technology, Volume 12, pages 574 and 575, the oxidation products of hydrocarbons are very useful as inhibitors, antiwear agents, lubricity additives as well as upper cylinder lubricant additives. These compounds are available under the trademark STP and under the trademark Alox. These compounds, when acting as inhibitors, are useful in delaying the formation of sludge, and the following explanation is given for the mechanism. Oil oxidation involves a chain reaction mechanism with hydroperoxide formation as the initiating step leading to the formation of organic acids and other oxygenated products. Added inhibitors and some naturally occurring aromatic petroleum compenents appear to interrupt this chain reaction by tying up the hydroperoxide. This action delays formation of varnish, sludge, and acids for extended operating periods and minimizes corrosion problems with lead babbitt, zinc, cadmium, and copper bearing alloys which are corroded by organic acids in oxidized oils. When these compenents act as antiwear agents, these oxygenated compounds produce a surface film by either a chemical or physical adsorption mechanism to minimize friction and wear under boundary lubrication conditions. The wide variety of compounds used for improved lubrication under boundary film conditions can be classified in seven main groups: (1) compounds containing oxygen (fatty acids, esters, ketones); (2) compounds containing sulfur or combinations of oxygen and sulfur; (3) organic chlorine compounds (chlorinated wax); (4) organic sulfur compounds (sulfurized fats, sulfurized olefins); (5) compounds containing both chlorine and sulfur; (6) organic phosphorus compounds (tricresyl phosphate, thiophosphates, phosphites); and (7) organic lead compounds. Of these seven main groups above indicated, only the compounds containing oxygen are used in accordance with the invention.

What is claimed is:

1. Composition consisting essentially of motor gasoline and pure colloidal magnesium to be used in an internal combustion engine:

said colloidal magnesium being in soap-free suspension in a small volume of kerosene, the particle size of said magnesium being from about 1 to about 500 millimicrons; and, said motor gasoline selected from the class consisting of leaded gasoline and unleaded gasoline, the magnesium of said suspension being present in relation to said gasoline at a critical concentraion of from at least 1/5 gram magnesium per 10 gallons of gasoline up to about 10 grams magnesium per 10 gallons of gasoline.

2. The combination of claim 1 wherein said gasoline is leaded gasoline and the concentration is about 1 – 2 grams magnesium per 10 gallons of gasoline.

3. The combination of claim 1 wherein said gasoline is unleaded gasoline and the concentration is about 2 –3 grams magnesium per 10 gallons of gasoline.

* * * * *